US009681702B2

(12) United States Patent
Francis et al.

(10) Patent No.: US 9,681,702 B2
(45) Date of Patent: Jun. 20, 2017

(54) FOOTWEAR WITH ELONGATED CLEATS

(71) Applicant: NIKE, Inc., Beaverton, OR (US)

(72) Inventors: Paul J. Francis, Beaverton, OR (US); Randall S. Wolfe, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/466,440

(22) Filed: Aug. 22, 2014

(65) Prior Publication Data

US 2016/0051011 A1 Feb. 25, 2016

(51) Int. Cl.

| | |
|---|---|
| ***A43B 13/22*** | (2006.01) |
| ***A43B 13/14*** | (2006.01) |
| ***A43B 5/00*** | (2006.01) |
| ***A43C 15/16*** | (2006.01) |

(52) U.S. Cl.

CPC ..... *A43B 13/223* (2013.01); *A43B 5/00* (2013.01); *A43B 13/141* (2013.01); *A43C 15/162* (2013.01)

(58) Field of Classification Search

CPC ..... A43B 13/223; A43B 13/22; A43B 13/26; A43B 5/00; A43B 5/001; A43B 5/02; A43C 15/16; A43C 15/162; A43C 15/167; A43C 15/02; A43C 15/04

USPC ..... 36/59 R, 126, 113, 114, 124, 127, 128, 36/134, 59 C, 67 R, 129; D02/908, 906, D02/960

See application file for complete search history.

(56) References Cited

U.S. PATENT DOCUMENTS

| | | | | |
|---|---|---|---|---|
| 4,135,317 | A | | 1/1979 | Ikeda |
| 4,212,120 | A | | 7/1980 | Bowerman et al. |
| D256,627 | S | * | 9/1980 | Lu ..... D2/906 |
| 4,288,929 | A | | 9/1981 | Norton et al. |
| 4,586,274 | A | | 5/1986 | Blair |
| 4,949,476 | A | | 8/1990 | Anderie |
| 5,339,544 | A | | 8/1994 | Caberlotto |
| 5,513,451 | A | | 5/1996 | Kataoka et al. |
| 5,775,010 | A | | 7/1998 | Kaneko |
| 5,829,172 | A | | 11/1998 | Kaneko |
| 5,943,794 | A | | 8/1999 | Gelsomini et al. |
| 6,032,388 | A | | 3/2000 | Fram |
| 6,061,931 | A | | 5/2000 | Kaneko |

(Continued)

FOREIGN PATENT DOCUMENTS

| | | |
|---|---|---|
| DE | 202014102743 U1 | 6/2014 |
| EP | 0115663 | 8/1984 |

(Continued)

OTHER PUBLICATIONS

Altra Trail Claw, accessed about Jun. 2013, 1 page http://www.altrazerodrop.com/fitness/en/Altra/Women/lone-peak-15-womens.

(Continued)

*Primary Examiner* — Clinton T Ostrup

*Assistant Examiner* — Heather Mangine

(74) *Attorney, Agent, or Firm* — Shook, Hardy & Bacon L.L.P.

(57) ABSTRACT

A sole for an article of footwear having elongated cleats is provided. The elongated cleats extend toward the toe end of the sole and toward the heel end of the sole such that the heel-ward end of each of the elongated cleats is closer to the midline than each corresponding toe-ward end of the elongated cleats. The configuration and position of the elongated cleats can provide increased lateral and forward stability for a wearer's feet.

19 Claims, 4 Drawing Sheets

(56) References Cited

U.S. PATENT DOCUMENTS

| | | | | |
|---|---|---|---|---|
| 6,457,264 | B2 | 10/2002 | Fusco et al. | |
| 6,467,196 | B1 | 10/2002 | Koyama | |
| 6,505,424 | B2 | 1/2003 | Oorei et al. | |
| 6,655,051 | B1 | 12/2003 | Peche et al. | |
| 6,701,644 | B2 | 3/2004 | Oorei et al. | |
| 6,782,642 | B2 | 8/2004 | Knoche et al. | |
| 6,826,852 | B2 | 12/2004 | Fusco | |
| 6,860,037 | B1 | 3/2005 | Norek | |
| 6,935,055 | B2 | 8/2005 | Oorei | |
| 7,337,559 | B2 | 3/2008 | Russell | |
| 7,827,705 | B2 * | 11/2010 | Baucom | A43B 13/026 36/134 |
| 7,877,900 | B2 | 2/2011 | Russell | |
| 7,921,580 | B2 | 4/2011 | Russell | |
| 8,028,442 | B2 | 10/2011 | Hodgson | |
| 8,261,392 | B2 | 9/2012 | Yabushita et al. | |
| 8,375,604 | B2 | 2/2013 | Eder et al. | |
| 8,567,096 | B2 | 10/2013 | Scholz | |
| 8,584,378 | B2 | 11/2013 | Weidl et al. | |
| 2005/0155254 | A1 | 7/2005 | Smith et al. | |
| 2007/0079530 | A1 * | 4/2007 | Fusco | A43B 5/06 36/129 |
| 2010/0154253 | A1 | 6/2010 | Imazato et al. | |
| 2010/0199523 | A1 | 8/2010 | Mayden et al. | |
| 2013/0067772 | A1 | 3/2013 | Auger et al. | |
| 2013/0067776 | A1 * | 3/2013 | Auger | A43B 5/02 36/25 R |
| 2013/0326911 | A1 | 12/2013 | Baucom et al. | |

FOREIGN PATENT DOCUMENTS

| | | | | |
|---|---|---|---|---|
| GB | 2328362 A | * | 2/1999 | A43B 3/0094 |
| GB | 2328362 A | * | 2/1999 | A43B 3/0094 |

OTHER PUBLICATIONS

International Search Report with Written Opinion dated Nov. 4, 2015 in Application No. PCT/US2015/045615, 16 pages.

International Preliminary Report on Patentability dated Mar. 9, 2017 in International Patent Application No. PCT/US2015/045615, 10 pages.

* cited by examiner

FOOTWEAR WITH ELONGATED CLEATS

TECHNICAL FIELD

The present disclosure relates to a sole for an article of footwear. More particularly, the present disclosure relates to a sole having elongated cleats.

BACKGROUND

In order to increase traction to the ground, certain footwear, such as shoes, can include cleats on the shoe sole. However, certain cleats or arrangements of cleats can negatively affect the forward and lateral stability of one's feet on the ground, which can result in decreased performance during various activities, such as running. Accordingly, there is a need for footwear that can provide increased forward and lateral stability in addition to increased traction.

BRIEF SUMMARY

This Summary is provided to introduce a selection of concepts in a simplified form that are further described below in the Detailed Description. This Summary is not intended to identify key features or essential elements of the claimed subject matter, nor is it intended to be used as an aid in determining the scope of the claimed subject matter. Aspects herein are defined by the claims.

One aspect is directed to a sole for an article of footwear that includes at least two elongated cleats. One of the elongated cleats is positioned on a medial side of a midline that extends from a toe end of the sole to a heel end of the sole, while the other elongated cleat is positioned on the lateral side of the midline. Both elongated cleats extend toward the toe end of the sole and toward the heel end of the sole such that the heel-ward end of each of the elongated cleats is closer to the midline than each corresponding toe-ward end of the elongated cleats. In addition, the sole includes a medial plurality of cleats positioned on the medial side of the midline such that the elongated cleat on the medial side is positioned between at least a portion of the medial plurality of cleats and the midline. Further, the sole includes a lateral plurality of cleats positioned on the lateral side of the midline such that the elongated cleat on the lateral side is positioned between the midline and at least a portion of the lateral plurality of cleats.

Another aspect is directed toward a sole for an article of footwear that includes two elongated cleats. One of the elongated cleats is positioned on a medial side of a midline that extends from a toe end of the sole to a heel end of the sole, while the other elongated cleat is positioned on the lateral side of the midline. Both elongated cleats extend toward the toe end of the sole and toward the heel end of the sole such that the heel-ward end of each of the elongated cleats is closer to the midline than each corresponding toe-ward end of the elongated cleats. In addition, each of the elongated cleats is positioned at an angle of less than 20° relative to the midline.

BRIEF DESCRIPTION OF THE DRAWINGS

Aspects herein are described in detail with reference to the attached drawing figures, wherein.

DETAILED DESCRIPTION

In general, aspects herein are directed toward an article of footwear, such as a shoe, having elongated cleats on the shoe sole. At least one elongated cleat can be positioned on each side of a midline that extends from the toe end to the heel end of the sole. The elongated cleats are oriented such that they generally extend toward a toe end and a heel end of the sole. In one aspect, the sole can include a plurality of cleats in addition to the elongated cleats. Shoes having the elongated cleats according to aspects herein can provide increased lateral and forward stability for the wearer's feet, in addition to providing increased ground traction.

Figure 1:
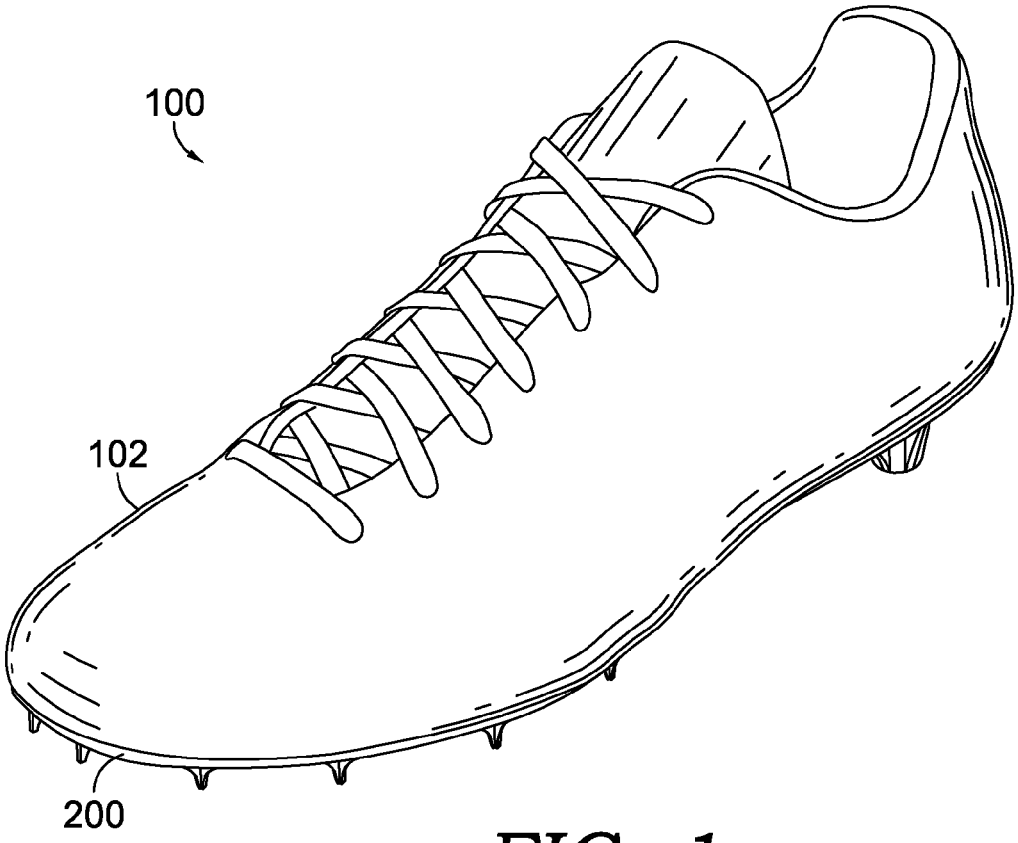
FIG. 1 depicts an exemplary article of footwear, in accordance with aspects herein.

FIG. 1 depicts an article of footwear 100 in accordance with various aspects herein. The article of footwear 100 has a general configuration suitable for various activities, such as walking, running, and the like. Exemplary articles of footwear may include athletic shoes, sandals, dress shoes, boots, loafers, and the like. The term "shoe" may be used herein for simplicity, in reference to various aspects of the articles of footwear. However, concepts described herein may be applied to a variety of other types of footwear.

The shoe 100 can generally include an upper 102 and a sole 200. Although the upper 102 depicted in FIG. 1 is presented in a simplified fashion for exemplary purposes, in practice, the upper 102 may include a large number of individual parts that may be formed from different types of materials. Alternatively, the upper 102 may be primarily formed from a single manufacturing technique, such as weaving or knitting, to form two or more portions of the shoe upper 102. The components of the upper 102 may be joined together using a variety of adhesives, stitches, and/or other types of joining/bonding components.

The sole 200 may include multiple components. For example, the sole 200 can include any combination of an insole, a midsole, and an outsole. As used herein, the term "sole" is defined as a sole having one or more of an insole, midsole, and outsole. An insole is typically an interior bottom of a shoe that sits directly beneath a person's foot under the footbed (commonly known as the sock liner). Insoles can be made from cellulosic paper board, synthetic nonwoven insole board, polymer-based materials, or the like.

A midsole may be added underneath the insole for comfort; to control the shape, moisture, or smell of a shoe; or for managing defects in the natural shape of the foot or positioning of the foot during standing, walking, running, etc. Midsoles may be made or integrated from foam, foam-cushioning sheets, latex, ethylene-vinyl acetate ("EVA"), polyurethane, plastic, thermoplastic, or a blend thereof. In an exemplary aspect, midsoles may not be made entirely from one type of material. For instance, soles may comprise air or gel pockets for support and/or steel or plastic toes for protection. Other variations are also possible and will generally be understood and appreciated by those skilled in the art.

An outsole may be connected to the bottom of a midsole. The outsole is, generally, the layer or layers of a shoe made for directly contacting the ground. Casual or athletic shoes usually have outsoles made from natural rubber, a plastic, or a synthetic material, such as polyurethane. The outsole may include a single piece of material or may be an assembly of separate pieces of different materials. Additionally, outsoles may include different fixtures for various purposes, such as cleats for traction. In particular, tread may be formed on outsoles in patterns to maximize gripping. For example, the tread of an outsole may include portions in circular, triangular, rectangular, pentagonal, hexagonal, octagonal, or other types of patterns.

The shoe sole 200 may further have additional components, such as additional cushioning components (such as springs, air bags, and the like), functional components (such as motion control elements to address pronation or supination), protective elements (such as resilient plates to prevent damage to the foot from hazards on the floor or ground), and the like. While these and other components that may be present in the sole 200 are not specifically described in examples herein, such components may be present in the shoe 100 in accordance with aspects hereof.

Figure 2:
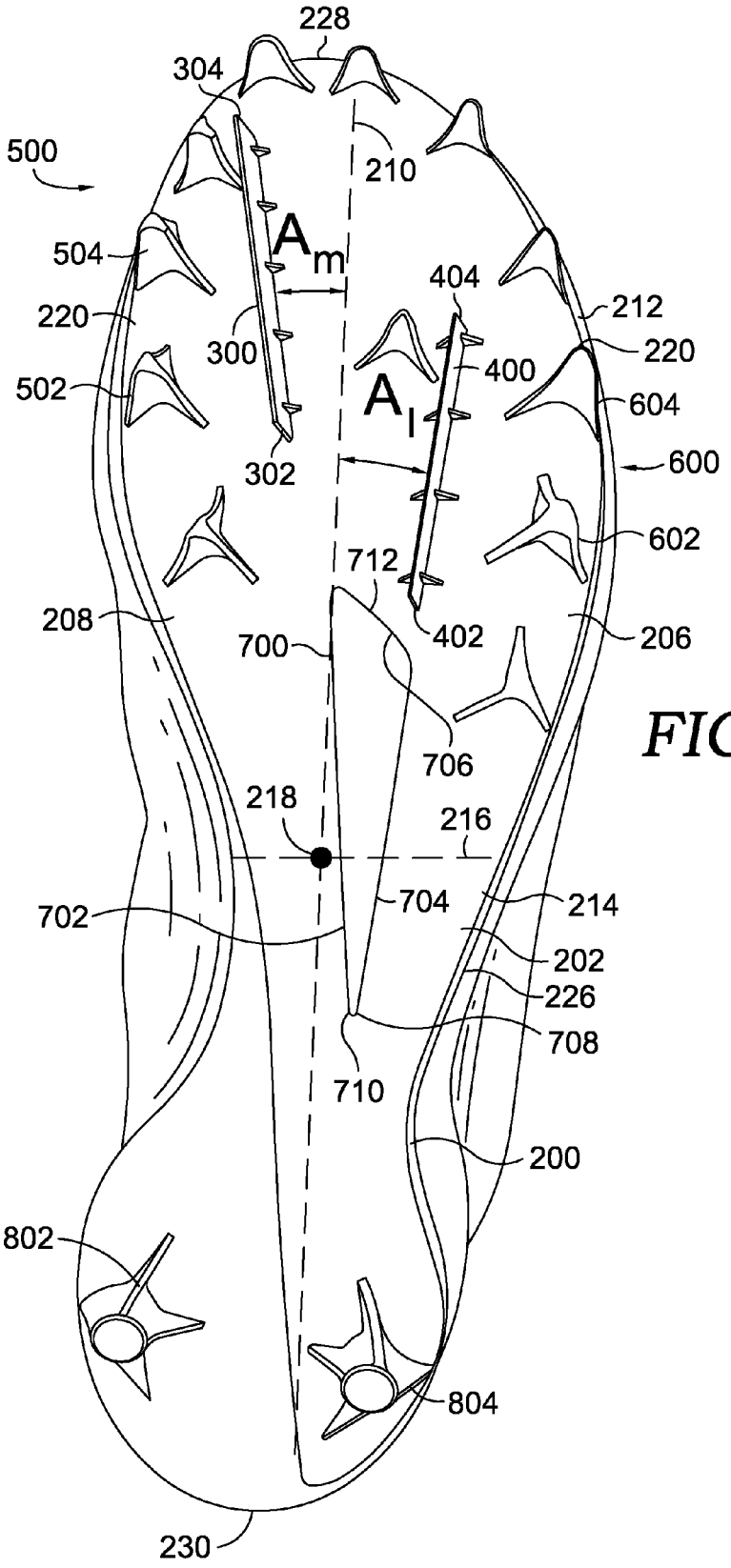
FIG. 2 depicts a bottom view of a sole for an article of footwear having two elongated cleats and a plurality of cleats, in accordance with aspects herein.

Turning now to FIG. 2, which depicts a bottom view of the sole 200 in accordance with aspects herein. The sole 200, generally, may include a lateral side 206 and a medial side 208. The lateral side 206 can include the portion of the sole 200 on the lateral side 206 of a sole midline 210 that extends from a toe end 228 to a heel end 230 of the sole 200. The medial side 208 can include the portion of the sole 200 on the medial side 208 of the sole midline 210.

The sole 200 can also include a toe-ward side 212 and a heel-ward side 214. The toe-ward side 212 can include the portion of the sole 200 on the toe-ward side 212 of a transverse midline 216 that extends through a midpoint 218 of the sole midline 210 in a substantially perpendicular manner. The heel-ward side 214 can include the portion of the sole 200 on the heel-ward side 214 of the transverse midline 216.

As seen in FIG. 2, the sole 200 may include an elongated cleat 300 positioned on the medial side 208 of the sole 200 (hereinafter referred to as the "medial elongated cleat") and another elongated cleat 400 positioned on the lateral side 206 of the sole 200 (hereinafter referred to as the "lateral elongated cleat"). The medial elongated cleat 300 and the lateral elongated cleat 400 can be positioned on the toe-ward side 212 of the transverse midline 216.

Various properties of the medial elongated cleat 300 and the lateral elongated cleat 400 can provide increased lateral and/or forward stability for a wearer's feet. For example, as discussed below, in certain aspects, specific positions of the elongated cleats 300 and 400 on the sole 200 and/or the length of the elongated cleats 300 and 400 can provide increased lateral and/or forward stability.

For increased forward stability, the medial elongated cleat 300 and the lateral elongated cleat 400 generally extend toward the toe end 228 and the heel end 230 of the sole 200. For example, the medial elongated cleat 300 can extend linearly toward the toe end 228 and linearly toward the heel end 230 of the sole 200 such that a heel-ward end 302 is closer to the midline 210 than a toe-ward end 304 of the medial elongated cleat 300. Similarly, the lateral elongated cleat 400 can extend toward the toe end 228 and the heel end 230 of the sole 200 such that a heel-ward end 402 of the lateral elongated cleat 400 is closer to the midline 210 than a toe-ward end 404 of the lateral elongated cleat 400.

In certain aspects, the medial elongated cleat 300 and/or the lateral elongated cleat 400 can be positioned at an acute angle relative to the midline 210. For example, the medial elongated cleat 300 of FIG. 2 extends toward the toe end 228 and the heel end 230 of the sole 200 and is positioned such that the angle $A_m$ is at least about 5° and/or not more than about 40° relative to the midline 210. For enhanced forward and lateral stability, the angle $A_m$ can be less than about 20° relative to the midline 210. In the same or alternative aspects, the lateral elongated cleat 400 extends toward the toe end 228 and the heel end 230 of the sole 200 and is positioned such that the angle $A_1$ is at least about 5° and/or not more than about 40° relative to the midline 210. Similarly, for enhanced lateral and forward stability, the angle $A_1$ should be less than about 20° relative to the midline 210.

In one or more aspects, the lateral elongated cleat 400 can have a length between a heel-ward end 402 and a toe-ward end 404 that is at least about 5% and/or not more than about 25% of the length of the midline 210. For enhanced forward stability, the length between a heel-ward end 402 and a toe-ward end 404 of the lateral elongated cleat 400 can be at least about 10% of the length of the midline 210. In the same or alternative aspects, the medial elongated cleat 300 can have length characteristics that are substantially similar to that of the lateral elongated cleat 400 discussed immediately above. In certain aspects, such as that depicted in FIG. 2, the medial elongated cleat 300 can have a length between the heel-ward end 302 and the toe-ward end 304 that is greater than the heel-ward end 402 to toe-ward end 404 length of the lateral elongated cleat 400.

As can be seen in FIG. 2, the sole 200 can include a medial plurality of cleats 500 and a lateral plurality of cleats 600, in accordance with aspects hereof. The medial plurality of cleats 500 can be positioned on the medial side 208 of the midline 210 and the toe-ward side 212 of the transverse midline 216, while the lateral plurality of cleats 600 can be positioned on the lateral side 206 of the midline 210 and the toe-ward side 212 of the transverse midline 216. In certain aspects, such as that depicted in FIG. 2, at least a portion of the medial plurality of cleats 500 can be positioned along a perimeter region 220 of the sole 200. In such aspects, the medial elongated cleat 300 can be positioned between the midline 210 and at least a portion of the medial plurality of cleats 500. For example, the medial elongated cleat 300 can be positioned between the cleats 502 and 504 and the midline 210 to achieve a desired traction performance provided by this exemplary configuration.

Like the medial plurality of cleats 500, at least a portion of the lateral plurality of cleats 600 of FIG. 2 can be positioned along the perimeter region 220 of the sole 200. In such aspects, the lateral elongated cleat 400 can be positioned between the midline 210 and at least a portion of the lateral plurality of cleats 600. For example, the lateral elongated cleat 400 can be positioned between the cleats 602 and 604 and the midline 210 to achieve a desired traction performance provided by this exemplary configuration.

As discussed above, various properties of the medial elongated cleat 300 and/or the lateral elongated cleat 400 can provide increased lateral and forward stability to a wearer's feet. In addition, the size and position of the medial plurality of cleats 500 and the lateral plurality of cleats 600, relative to the size and position of the medial elongated cleat 300 and the lateral elongated cleat 400, respectively, can also provide increased lateral and forward stability. For example, the medial elongated cleat 300 can have a length between the heel-ward end 302 and the toe-ward end 304 that extends along at least two of the medial plurality of cleats 500. As shown in FIG. 2, the medial elongated cleat 300 extends along the length of the cleats 502 and 504 of the medial plurality of cleats 500. In the same or alternative aspects, the lateral elongated cleat 400 can have a length between the heel-ward end 402 and the toe-ward end 404 that extends along at least the cleats 602 and 604 of the lateral plurality of cleats 600.

In order to decrease the weight of the sole 200 without sacrificing stability, the sole 200 may include an elongated void 700. In certain aspects, the elongated void 700 can extend through an outsole material 202 of the sole 200. In alternative aspects, the elongated void 700 can extend through an outsole material 202 and a midsole material 226 of the sole 200. As can be seen in FIG. 2, a medial edge 702 and a lateral edge 704 of the elongated void 700 can extend toward the toe end 228 and toward the heel end 230 of the sole 200, where both the lateral edge 704 and the medial edge 702 transect the transverse midline 216. The lateral edge 704 and the medial edge 702 converge to a point 708 at the heel-ward end 710 of the elongated void 700. The elongated void 700 can also include a toe-ward edge 706 to connect the medial edge 702 and the lateral edge 704 at the toe-ward end 712 of the void 700.

In aspects, the position of the void 700 relative to the other features of the sole 200 can provide increased stability to a wearer's feet and structural stability to the sole 200. For example, the medial edge 702 of the void 700 can be substantially parallel to the toe-ward end 304 to heel-ward end 302 direction of extension of the medial elongated cleat 300. Similarly, the lateral edge 704 of the void 700 can be substantially parallel to the toe-ward end 404 to heel-ward end 402 direction of extension of the lateral elongated cleat 400.

In certain aspects, the sole 200 can include at least one heel cleat (e.g., heel cleat 802 and/or heel cleat 804) positioned on the heel-ward side 214 of the transverse midline 216. In one or more aspects, the heel cleat 802 can be positioned on the medial side 208 of the sole midline 210, and the heel cleat 804 can be positioned on the lateral side 206 of the sole midline 210.

Figure 3:
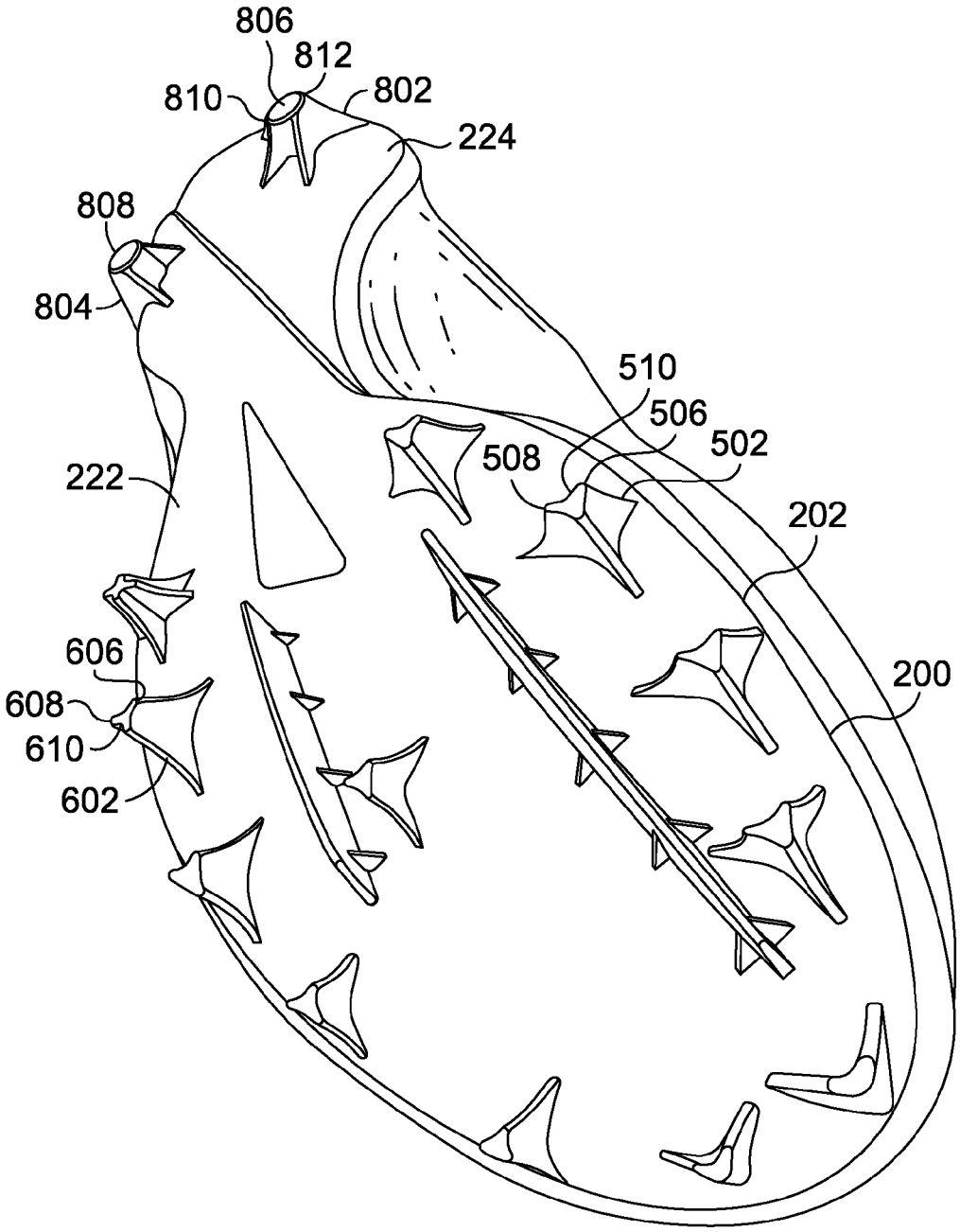
FIG. 3 depicts a front perspective view of the sole depicted in FIG. 2, in accordance with aspects herein.

FIG. 3 depicts a front perspective view of the sole 200 of FIG. 2, in accordance with aspects hereof. As can be seen in FIG. 3, the heel cleats 802 and 804 are structured differently than the medial plurality of cleats 500 and the lateral plurality of cleats 600. For example, in aspects, a distal surface 806 of the heel cleat 802 has a maximum width between a lateral-most edge 810 and a medial-most edge 812 that is greater than the maximum width between a medial-most edge and a lateral-most edge of the distal surface of each of the medial plurality of cleats 500 and the lateral plurality of cleats 600. As can be seen in FIG. 3, the maximum width between a medial-most edge 506 and a lateral-most edge 508 of the distal surface 510 of the medial cleat 502 is less than the maximum width of the distal surface 806 of the heel cleat 802. Likewise, the maximum width between a medial-most edge 606 and a lateral-most edge 608 of the distal surface 610 of the lateral cleat 602 is less than the maximum width of the distal surface 806 of the heel cleat 802. In the same or alternative aspects, the heel cleat 804 can include the same maximum width properties of its distal surface 808 as the heel cleat 802.

As discussed above, the sole 200 can include an outsole material 202. In certain aspects, the sole 200 can include an outsole material 202 having varying levels of thickness. For example, as seen in FIG. 3, the sole 200 can include an outsole material 202 having the surfaces 222 and 224, where the surface 224 is at least partially recessed relative to the surface 222.

Figure 4:
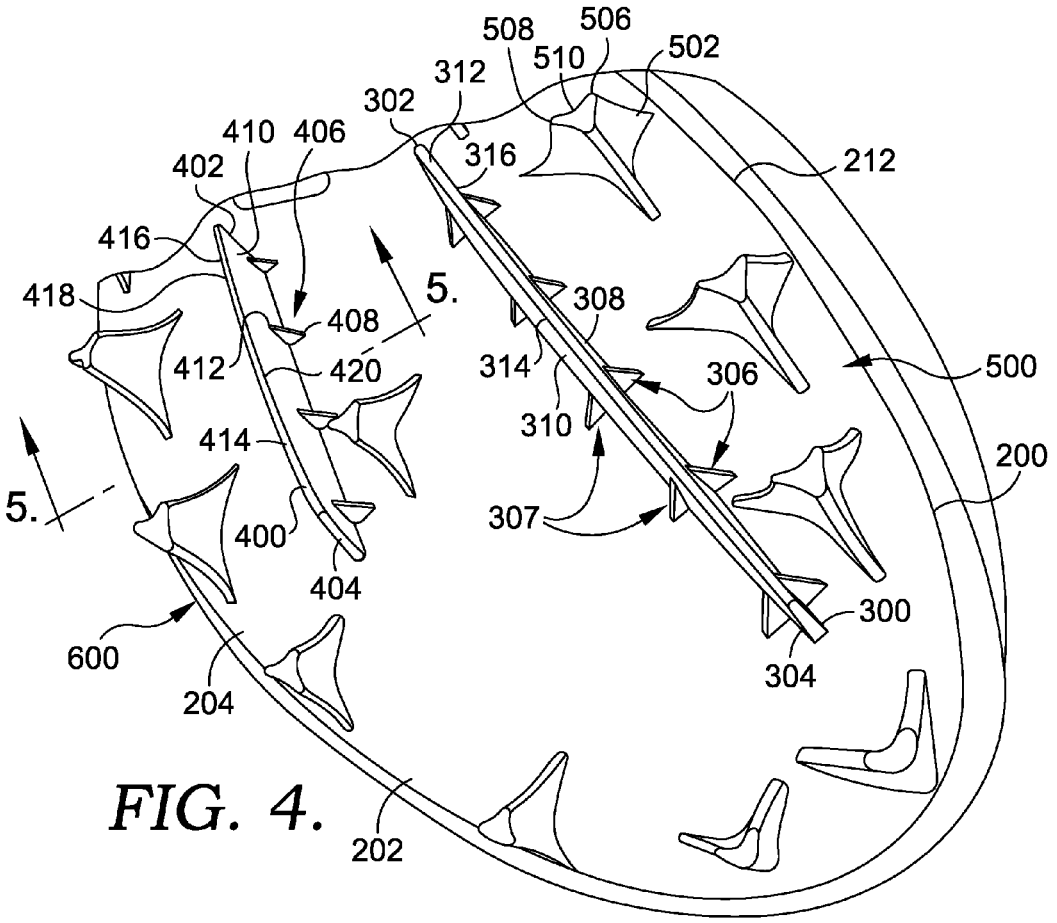
FIG. 4 depicts a front perspective view of a portion of the toe-ward side of the sole depicted in FIG. 2, in accordance with aspects herein.

FIG. 4 provides a close-up front perspective view of a portion of the toe-ward side 212 of the sole 200 to further illustrate additional features of the elongated cleats 300 and 400, in accordance with aspects hereof. For example, the medial elongated cleat 300 can include a plurality of support elements 306 positioned on the medial facing edge 308 and a plurality of support elements 307 positioned on the lateral facing edge 310 of the medial elongated cleat 300. In one or more aspects, such as that depicted in FIG. 4, each of the plurality of support elements 306 and/or 307 can be positioned transverse to the direction of extension between the toe-ward end 304 and the heel-ward end 302 of the medial elongated cleat 300. In the same or alternative aspects, the lateral elongated cleat 400 can include a plurality of support elements 406 that are similar to the plurality of support elements 306 and/or 307 for the medial elongated cleat 300. For example, the plurality of support elements 406 can be positioned transverse to the direction of extension between the toe-ward end 404 and the heel-ward end 402 of the lateral elongated cleat 400.

In one or more aspects, the support elements 306 can be integral with the medial elongated cleat 300. For example, the support elements 306 and the medial elongated cleat 300 can be made of one contiguous material, such as any of the materials described above with reference to the sole 200. In addition, the support elements 306 can be integral with an outsole material 202 of the sole 200. In the same or alternative aspects, the support elements 406 can be integral with the lateral elongated cleat 400 and/or an outsole material 202 of the sole 200.

In aspects, each of the plurality of support elements 406 can contact the outer surface 204 of an outsole material 202 and at least a portion of the elongated cleat 400. For example, as seen in FIG. 4, the support element 408 can contact the outer surface 204 of the outsole material 202 while in contact with the medial facing side 410 of the lateral elongated cleat 400. The support element 408 can extend up the medial facing side 410 of the lateral elongated cleat 400 such that the distal end 412 of the support element 408 is positioned below the distal surface 414 of the lateral elongated cleat 400. In addition, a portion of the plurality of support elements 406 can contact the lateral facing side 416 of the lateral elongated cleat 400 and extend up a portion of the lateral facing side 416, as described above with reference to the support element 408. In the same or alternative aspects, each of the plurality of support elements 306 can contact and extend up a portion of a side (medial facing 308 or lateral facing 310) of the medial elongated cleat 300, as described above with reference to the support element 408.

Figure 5:
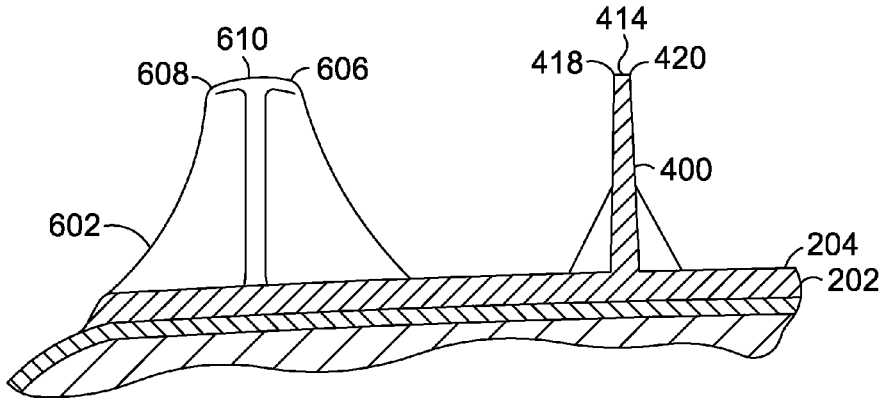
FIG. 5 depicts a front cross-sectional view along cutline 5 of the portion of the toe-ward side of the sole depicted in FIG. 4, in accordance with aspects herein.

In certain aspects, the thickness of the medial elongated cleat 300 and/or the lateral elongated cleat 400 can be less than the thickness of the plurality of cleats 500 and/or 600. For example, the distal surface 414 of the lateral elongated cleat 400 can have a maximum width between a lateral facing edge 418 and a medial facing edge 420 that is less than the maximum width of the distal surface between a medial-most edge and a lateral-most edge of each of the lateral plurality of cleats 600 and/or the medial plurality of cleats 500. As best seen in FIG. 5, which depicts a cross-sectional view along the cutline 5 illustrated in FIG. 4, the lateral elongated cleat 400 has a maximum width between a lateral facing edge 418 and a medial facing edge 420 that is less than the maximum width of the distal surface 610 between the medial-most edge 606 and the lateral most-edge 608 of the lateral cleat 602.

In certain aspects, the maximum width of the distal surface 312 of the medial elongated cleat 300 is less than the maximum width of the distal surface of each of the medial plurality of cleats 500 and/or the lateral plurality of cleats 600. For example, as shown in FIG. 4, the medial elongated cleat 300 has a distal surface 312 with a maximum width between the lateral facing edge 314 and the medial-facing edge 316 that is less than the maximum width of the distal surface 510 between a medial-most edge 506 and a lateral-most edge 508 of the cleat 502. This difference in width between the elongated cleats and the plurality of cleats, in exemplary aspects, provides an advantageous traction profile effective for an exemplary intended use of the footwear.

As discussed above, in various aspects, the sole 200 can include an outsole material 202. In such aspects, the medial elongated cleat 300 and/or the lateral elongated cleat 400 can extend outward from an outer surface 204 of the outsole material 202. For example, as can be seen in FIG. 5 that depicts a cross-sectional view along cutline 5 of FIG. 4, the lateral elongated cleat 400 can extend outward from the outer surface 204 of the outsole material 202, in accordance with aspects hereof. Further, in such aspects, the medial elongated cleat 300 and/or the lateral elongated cleat 400 can be integral with the outer surface 204 of the outsole material 202. For example, as seen in FIG. 5, the lateral elongated cleat 400 and at least the outsole material 202 can be one contiguous material.

In aspects not depicted in the figures, a medial elongated cleat, e.g., the medial elongated cleat 300, and a lateral elongated cleat, e.g., the lateral elongated cleat 400, can be present on a sole of a shoe, e.g., the sole 200 of the shoe 100, in the absence of additional cleats, such as the medial plurality of cleats 500 and the lateral plurality of cleats 600. In such aspects, the medial elongated cleat and/or the lateral elongated cleat can have the same properties and parameters as discussed above with reference to FIGS. 2-5.

The following listing of exemplary aspects supports and is supported by the discussion provided herein.

Aspect 1

A sole for an article of footwear, the sole comprising a medial plurality of cleats positioned on a medial side of a sole midline that extends from a toe end to a heel end of the sole; a first elongated cleat extending toward the toe end and the heel end of the sole between at least a portion of the medial plurality of cleats and the sole midline such that a heel-ward end of the first elongated cleat is closer to the sole midline than a toe-ward end of the first elongated cleat; a lateral plurality of cleats positioned on a lateral side of the sole midline; and a second elongated cleat extending toward the toe end and the heel end of the sole between at least a portion of the lateral plurality of cleats and the sole midline such that a heel-ward end of the second elongated cleat is closer to the sole midline than a toe-ward end of the second elongated cleat.

Aspect 2

The sole according to aspect 1, wherein the first elongated cleat has a length between the heel-ward end and the toe-ward end that extends along at least two of the medial plurality of cleats.

Aspect 3

The sole according to aspect 1, wherein the second elongated cleat has a length between the heel-ward end and the toe-ward end that is at least 10% of the length of the sole midline.

Aspect 4

The sole according to aspect 3, wherein the first elongated cleat has a length between the heel-ward end and the toe-ward end that is greater than the length between the heel-ward end and the toe-ward end of the second elongated cleat.

Aspect 5

The sole according to aspect 1, wherein the first and second elongated cleats are positioned on a toe-ward side of a transverse midline that extends substantially perpendicular to the sole midline through a midpoint of the sole midline.

Aspect 6

The sole according to aspect 1, wherein the first elongated cleat comprises a distal surface having a maximum width between a lateral facing edge and a medial facing edge, wherein each of the medial plurality of cleats comprises a distal surface having a maximum width between a medial-most edge and a lateral-most edge, wherein the maximum width of the first elongated cleat distal surface is less than the maximum width of the distal surface of each of the medial plurality of cleats.

Aspect 7

The sole according to aspect 1, further comprising at least one heel cleat, the heel cleat positioned on a heel-ward side of a transverse midline that extends substantially perpendicular to the sole midline through a midpoint of the sole midline.

Aspect 8

The sole according to aspect 7, wherein the heel cleat comprises a distal surface having a maximum width between a medial-most edge and a lateral-most edge, wherein each of the medial plurality of cleats and the lateral plurality of cleats comprises a distal surface having a maximum width between a medial-most edge and a lateral-most edge, wherein the maximum width of the heel cleat distal surface is greater than the maximum width of the distal surface of each of the lateral plurality of cleats and the medial plurality of cleats.

Aspect 9

The sole according to aspect 1, further comprising an outsole material, wherein the first and second elongated cleats extend outward from an outer surface of the outsole material, and wherein the first and second elongated cleats are integral with the outer surface of the outs ole material.

Aspect 10

The sole according to aspect 1, wherein the first elongated cleat comprises a plurality of support elements, and wherein each of the plurality of support elements is positioned transverse to the direction of extension between the toe-ward end and the heel-ward end of the first elongated cleat.

Aspect 11

The sole according to aspect 10, wherein each of the plurality of support elements contacts and extends up a portion of a side of the first elongated cleat such that a distal end of each of the plurality of support elements contacts the side of the first elongated cleat below a distal surface of the first elongated cleat.

Aspect 12

The sole according to aspect 10, wherein each of the plurality of support elements is integral with the first elongated cleat.

Aspect 13

A sole for an article of footwear, the sole comprising a first elongated cleat extending toward a toe end and a heel end of the sole, the first elongated cleat being positioned on a medial side of a sole midline that extends from the toe end to the heel end of the sole such that a heel-ward end of the first elongated cleat is closer to the sole midline than a toe-ward end of the first elongated cleat, the first elongated cleat angled at less than 20 degrees relative to the sole midline; and a second elongated cleat extending toward the toe end and the heel end of the sole, the second elongated cleat being positioned on a lateral side of the sole midline such that a heel-ward end of the second elongated cleat is closer to the sole midline than a toe-ward end of the second elongated cleat, the second elongated cleat angled at less than 20 degrees relative to the sole midline.

Aspect 14

The sole according to aspect 13, wherein the second elongated cleat has a length between the heel-ward end and the toe-ward end that is at least about 10% of the length of the sole midline.

Aspect 15

The sole according to aspect 14, wherein the first elongated cleat has a length between the heel-ward end and the toe-ward end that is greater than the length between the heel-ward end and the toe-ward end of the second elongated cleat.

Aspect 16

The sole according to aspect 13, wherein the first and second elongated cleats are positioned on a toe-ward side of a transverse midline that extends substantially perpendicular to the sole midline through a midpoint of the sole midline.

Aspect 17

The sole according to aspect 13, further comprising an outsole material, wherein the first and second elongated cleats extend outward from an outer surface of the outsole material, and wherein the first and second elongated cleats are integral with the outer surface of the outsole material.

Aspect 18

The sole according to aspect 13, wherein the first elongated cleat comprises a plurality of support elements, wherein each of the plurality of support elements is positioned transverse to the direction of extension between the toe-ward end and the heel-ward end of the first elongated cleat, and wherein each of the plurality of support elements contacts and extends up a portion of a side of the first elongated cleat such that a distal end of each of the plurality of support elements contacts the side of the first elongated cleat below a distal surface of the first elongated cleat.

Aspect 19

The sole according to aspect 13, further comprising a plurality of cleats, wherein at least a portion of the plurality of cleats are positioned on a medial side of the sole midline, and wherein at least a portion of the plurality of cleats are positioned on a lateral side of the sole midline.

Aspect 20

The sole according to aspect 19, wherein the first elongated cleat comprises a distal surface having a maximum width between a lateral facing edge and a medial facing edge, wherein each of the plurality of cleats comprises a distal surface having a maximum width between a medial-most edge and a lateral-most edge, and wherein the maximum width of the first elongated cleat distal surface is less than the maximum width of the distal surface of each of the plurality of cleats.

From the foregoing, it will be seen that aspects herein are well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible aspects may be made without departing from the scope thereof, it is to be understood that all matter herein set forth or shown in the accompanying drawings is to be interpreted as illustrative and not in a limiting sense.

While specific elements and steps are discussed in connection to one another, it is understood that any element and/or steps provided herein is contemplated as being combinable with any other elements and/or steps regardless of explicit provision of the same while still being within the scope provided herein. Since many possible aspects may be made of the disclosure without departing from the scope thereof, it is to be understood that all matter herein set forth or shown in the accompanying drawings is to be interpreted as illustrative and not in a limiting sense.

The invention claimed is:

1. A sole for an article of footwear, the sole comprising:

a medial plurality of cleats positioned on a medial side of a sole midline that extends from a toe end to a heel end of the sole;

a first elongated cleat extending linearly toward the toe end and the heel end of the sole between at least a portion of the medial plurality of cleats and the sole midline such that a heel-ward end of the first elongated cleat is closer to the sole midline than a toe-ward end of the first elongated cleat, wherein the first elongated cleat comprises a first plurality of individual support elements positioned on a medial facing edge of the first elongated cleat and a second plurality of individual support elements positioned on a lateral facing edge of the first elongated cleat, wherein the lateral facing edge and the medial facing edge of the first elongated cleat extend away from the sole and at least partly define a maximum width of a distal surface of the first elongated cleat, wherein the lateral facing edge and the medial facing edge of the first elongated cleat are spaced apart from one another at the distal surface, and wherein the first elongated cleat has a length between the heel-ward end and the toe-ward end that extends along at least two of the medial plurality of cleats;

a lateral plurality of cleats positioned on a lateral side of the sole midline; and a second elongated cleat extending toward the toe end and the heel end of the sole between at least a portion of the lateral plurality of cleats and the sole midline such that a heel-ward end of the second elongated cleat is closer to the sole midline than a toe-ward end of the second elongated cleat.

2. The sole according to claim 1, wherein the second elongated cleat has a length between the heel-ward end and the toe-ward end that is at least 10% of the length of the sole midline.

3. The sole according to claim 2, wherein the first elongated cleat has a length between the heel-ward end and the toe-ward end that is greater than the length between the heel-ward end and the toe-ward end of the second elongated cleat.

4. The sole according to claim 1, wherein the first and second elongated cleats are positioned on a toe-ward side of a transverse midline that extends substantially perpendicular to the sole midline through a midpoint of the sole midline.

5. The sole according to claim 1, wherein each of the medial plurality of cleats comprises a distal surface having a maximum width between a medial-most edge and a lateral-most edge, wherein the maximum width of the first elongated cleat distal surface is less than the maximum width of the distal surface of each of the medial plurality of cleats, and wherein the first elongated cleat distal surface and the distal surface of at least one of the medial plurality of cleats are substantially the same distance away from the sole.

6. The sole according to claim 1, further comprising at least one heel cleat, the heel cleat positioned on a heel-ward side of a transverse midline that extends substantially perpendicular to the sole midline through a midpoint of the sole midline.

7. The sole according to claim 6, wherein the heel cleat comprises a distal surface having a maximum width between a medial-most edge and a lateral-most edge, wherein each of the medial plurality of cleats and the lateral plurality of cleats comprises a distal surface having a maximum width between a medial-most edge and a lateral-most edge, wherein the maximum width of the heel cleat distal surface is greater than the maximum width of the distal surface of each of the lateral plurality of cleats and the medial plurality of cleats.

8. The sole according to claim 1, further comprising an outsole material, wherein the first and second elongated cleats extend outward from an outer surface of the outsole material, and wherein the first and second elongated cleats are integral with the outer surface of the outsole material.

9. The sole according to claim 1, wherein each of the first plurality of individual support elements and the second plurality of individual support elements is positioned transverse to the direction of extension between the toe-ward end and the heel-ward end of the first elongated cleat, and wherein at least a portion of the first plurality of individual support elements are spaced apart from one another.

10. The sole according to claim 9, wherein each of the first plurality of individual support elements contacts and extends up a portion of the medial facing edge of the first elongated cleat such that a distal end of each of the first plurality of individual support elements contacts the medial facing edge of the first elongated cleat below a distal surface of the first elongated cleat.

11. The sole according to claim 9, wherein each of the first plurality of individual support elements and the second plurality of individual support elements is integral with the first elongated cleat.

12. A sole for an article of footwear, the sole comprising:

a plurality of cleats;

a first elongated cleat extending linearly toward a toe end and a heel end of the sole, the first elongated cleat being positioned on a medial side of a sole midline that extends from the toe end to the heel end of the sole such that a heel-ward end of the first elongated cleat is closer to the sole midline than a toe-ward end of the first elongated cleat, the first elongated cleat angled at less than 20 degrees relative to the sole midline, wherein the first elongated cleat comprises a first plurality of individual support elements positioned on a medial facing edge of the first elongated cleat and a second plurality of individual support elements positioned on a lateral facing edge of the first elongated cleat, wherein the lateral facing edge and the medial facing edge of the first elongated cleat extend away from the sole and at least partly define a maximum width of a distal surface of the first elongated cleat, wherein the lateral facing edge and the medial facing edge of the first elongated cleat are spaced apart from one another at the distal surface, and wherein the first elongated cleat has a length between the heel-ward end and the toe-ward end that extends along at least two of the plurality of cleats; and a second elongated cleat extending toward the toe end and the heel end of the sole, the second elongated cleat being positioned on a lateral side of the sole midline such that a heel-ward end of the second elongated cleat is closer to the sole midline than a toe-ward end of the second elongated cleat, the second elongated cleat angled at less than 20 degrees relative to the sole midline.

13. The sole according to claim 12, wherein the second elongated cleat has a length between the heel-ward end and the toe-ward end that is at least about 10% of the length of the sole midline.

14. The sole according to claim 13, wherein the length between the heel-ward end and the toe-ward end of the first elongated cleat is greater than the length between the heel-ward end and the toe-ward end of the second elongated cleat.

15. The sole according to claim 12, wherein the first and second elongated cleats are positioned on a toe-ward side of a transverse midline that extends substantially perpendicular to the sole midline through a midpoint of the sole midline.

16. The sole according to claim 12, further comprising an outsole material, wherein the first and second elongated cleats extend outward from an outer surface of the outsole material, and wherein the first and second elongated cleats are integral with the outer surface of the outsole material.

17. The sole according to claim 12, wherein each of the first plurality of individual support elements and the second plurality of individual support elements is positioned transverse to the direction of extension between the toe-ward end and the heel-ward end of the first elongated cleat, and wherein each of the first plurality of individual support elements contacts and extends up a portion of the medial facing edge of the first elongated cleat such that a distal end of each of the first plurality of individual support elements contacts the medial facing edge of the first elongated cleat below a distal surface of the first elongated cleat.

18. The sole according to claim 13, wherein at least a portion of the plurality of cleats are positioned on a medial side of the sole midline.

19. The sole according to claim 18, wherein each of the plurality of cleats comprises a distal surface having a maximum width between a medial-most edge and a lateral-most edge, and wherein the maximum width of the first elongated cleat distal surface is less than the maximum width of the distal surface of each of the plurality of cleats, and wherein the first elongated cleat distal surface and the distal surface of at least one of the medial plurality of cleats are substantially the same distance away from the sole.

* * * * *